US005555815A

United States Patent [19]

Young et al.

[11] Patent Number: 5,555,815

[45] Date of Patent: Sep. 17, 1996

[54] MODEL TRAIN HORN CONTROL SYSTEM

[75] Inventors: Neil P. Young, 3240 Bear Gulph Rd., Redwood City, Calif. 94062; Joe Thibodeau, Los Gatos; David Trubitt, San Carlos; Dennis Fowler, Los Altos, all of Calif.

[73] Assignee: Neil P. Young, Redwood City, Calif.

[21] Appl. No.: 322,892

[22] Filed: Oct. 13, 1994

[51] Int. Cl.[6] ..... B60L 1/00

[52] U.S. Cl. ..... 104/296; 446/410; 446/381; 446/61

[58] Field of Search ..... 246/473 A; 104/295, 104/296; 446/409, 410, 454; 381/61

[56] References Cited

U.S. PATENT DOCUMENTS

| | | | |
|---|---|---|---|
| 2,247,418 | 7/1941 | Smith | 246/31 |
| 2,882,834 | 4/1959 | Smith | 104/296 |
| 3,664,060 | 5/1972 | Longnecker | 446/410 |
| 3,839,822 | 10/1974 | Rexford | 446/410 |
| 4,247,107 | 1/1981 | Smith et al. | 104/296 |
| 4,270,226 | 5/1981 | Weintraub | 455/353 |
| 4,325,199 | 4/1982 | McEdwards | 446/130 |
| 4,481,661 | 11/1984 | Spector | 381/61 |
| 4,933,980 | 6/1990 | Thompson | 381/61 |
| 4,964,837 | 10/1990 | Collier | 446/409 |
| 5,024,626 | 6/1991 | Robbins et al. | 446/409 |
| 5,061,905 | 10/1991 | Truchsess | 446/409 |
| 5,088,955 | 2/1992 | Ishimoto | 446/409 |
| 5,174,216 | 12/1992 | Miller et al. | 446/410 |
| 5,267,318 | 11/1993 | Severson et al. | 446/409 |

FOREIGN PATENT DOCUMENTS

| | | | |
|---|---|---|---|
| 2361538 | 6/1975 | Germany | 446/410 |
| 2425427 | 12/1975 | Germany | 446/410 |
| 2738820 | 3/1979 | Germany | 446/410 |
| 3009040 | 9/1981 | Germany . | |
| 7801499 | 10/1979 | Switzerland | 446/410 |
| 1436814 | 5/1976 | United Kingdom | 446/410 |

*Primary Examiner*—Mark T. Le

*Attorney, Agent, or Firm*—Townsend and Townsend and Crew

[57] ABSTRACT

A horn control system for model vehicles on a track includes a sound generation unit mounted on the model vehicle which generates different sounds based on the combination of two inputs, the speed of the vehicle and an operator initiated horn signal. The type of sound is also preferably varied based on how long the horn button is depressed.

19 Claims, 3 Drawing Sheets

MODEL TRAIN HORN CONTROL SYSTEM

BACKGROUND OF THE INVENTION

The present invention relates to horn control systems for model trains.

Model train systems have been in existence for many years. In a typical system, the model train engine is an electrical engine which receives power from a voltage which is applied to the tracks and is picked up by the train motor. A transformer is used to apply the power to the tracks. The transformer controls both the amplitude and polarity of the voltage, thereby controlling the speed and direction of the train. In HO systems, the voltage is a DC voltage. In Lionel systems, the voltage is an AC voltage transformed from the 60 HZ line voltage available in a standard wall socket.

In addition to controlling the direction and speed of a train, model train enthusiasts have a desire to control other features of the train, such as the whistle and other noises typically generated by a locomotive. Hobbyists strive to achieve realism in all facets of the model railroad layout, including the size, features, and sounds of the train. Lionel presently allows for control of the whistle by providing a horn button located on the transformer. When the button is activated, a DC voltage is imposed on top of the AC line voltage, which is then picked up by the locomotive. The horn has a single tone available. These previous horns produced sound in three simple repetitive segments, and limited the variety and qualities of sound available to the user to a single sound, variable in length by the amount of time the user held down the horn control button.

One method of achieving greater realism in the train sound is disclosed in Rexford, U.S. Pat. No. 3,389,822. This patent teaches a means for simulating the puffing sound of a locomotive by responding to the rotation of a wheel. In Smith, U.S. Pat. No. 2,882,834, a sound system is disclosed which produces pulsating engine sounds by varying the sound based on driving strength of the magnetic field of a solenoid in the train engine. One problem with such systems is that each produces only a limited range of sounds, based on a single set of inputs. Further, the user does not have complete control over the initiation and duration of the sound.

Another method, designed for trackless, remote control vehicles, is disclosed in Collier, U.S. Pat. No. 4,964,837 where a self-contained sound system is shown. The system produces specific sounds based on different sensor inputs, such as a crash, or the squeal of tires. Again, the system suffers in that the user does not have control over the initiation and duration of the simulated sounds. Each of the previous systems fall short in providing the desired realism required to accurately recreate the sound and feel of an actual vehicle such as a locomotive.

Accordingly, what is needed is a sound generation system which gives an operator the ability to simulate a wide variety of locomotive noises, or to create "signature" sounds like the engineers of a real train, thus increasing the amount of realism a hobbyist may achieve in a system.

SUMMARY OF THE INVENTION

The present invention solves these and other needs by providing a sound system for model vehicles on a track which produces a wide range of sounds based upon an input from the user and the speed of the vehicle.

The sound system allows a user to produce a variable sound from a model vehicle, such as a train. The system includes an offset sensor placed in the model vehicle which is responsive to a horn signal initiated by a user. The model vehicle, in one embodiment, also carries a speed sensor which is responsive to movement of the model vehicle along the track, and which produces a signal indicating the speed of the vehicle. A sound generation unit is also carried on the vehicle. The unit has inputs coupled to the offset and speed sensors and has an output connected to a speaker to produce a variety of sounds based on both the speed of the vehicle and the duration of the horn signal. The type of sound is also preferably varied based on how long the horn button is repressed.

In another embodiment, the vehicle carries a sensor which is responsive to track voltage rather than the actual speed of the vehicles.

The sound generation unit stores a variety of sounds, allowing the production of a wide range of railroad noises. The sounds produced by the unit are realistic because they are selected and played based on a combination of inputs. As an example, soft sounds will generally be produced when the train is stationary, while louder sounds will be produced when the train is moving at high speed. The system solves the problems associated with the prior art devices by providing a user controlled sound system capable of producing a wide range of realistic sounds. The user retains control over the initiation and duration of the horn. Every sound is of high quality because each horn is broken into, e.g., at least three discrete segments reproduced from actual digitized recordings of train sounds.

In one embodiment of the present invention, the variety of horn sounds created is further embellished by overlaying two types of background noises. Specifically, background noises may consist of sounds generated based upon the speed of the train and noises dependent solely upon the type of train being operated. As an example, in an embodiment simulating a steam locomotive (versus, e.g., a diesel locomotive), steam release sounds are produced when the engine slows down after travelling at a high rate of speed. Occasionally, the ping or clank of a compressor may also sound, thus providing a highly accurate representation of an actual steam locomotive. Further realism is achieved by utilizing actual digitized recordings of each of the sounds produced.

Even though the sound generation unit can store and create numerous sounds which constantly vary, the present invention allows the user to replicate a preferred sound by reasserting the horn signal within a specific time period, such as 3–5 seconds.

In one embodiment, the present invention is controlled by use of the existing horn button which is located on Lionel transformers which generates a DC pulse on the tracks. In another embodiment, the sound system is activated by signals transmitted via electromagnetic pulses carried along the tracks. Such a control system is described in the co-pending patent application, Ser. No. 08/134,102, entitled "MODEL TRAIN CONTROLLER USING ELECTROMAGNETIC FIELD BETWEEN TRACK AND GROUND" by Neil P Young, et al, filed on Oct. 8, 1993, and incorporated herein by reference.

In another specific embodiment of the present invention, the sound generation unit is responsive to the amount of time the model vehicle is turned off. The sound generation unit may produce differing sounds based on how long the unit has been turned off. Sounds may also be generated when the unit is powered on.

A preferred embodiment of the present invention utilizes a microcontroller coupled to a sound ROM and a speaker system, all of which are carried in the model vehicle. The system may be integrated into vehicles during their manufacture, or may be installed by the user as a retrofit item. In one embodiment, the sound ROM may be customized to match a particular vehicle, e.g., a diesel or a steam train, or even a specific type of a particular vehicle.

For a fuller understanding of the nature and advantages of the invention, reference should be made to the ensuing description taken in conjunction with the accompanying drawings.

DESCRIPTION OF THE PREFERRED EMBODIMENT

Figure 1:
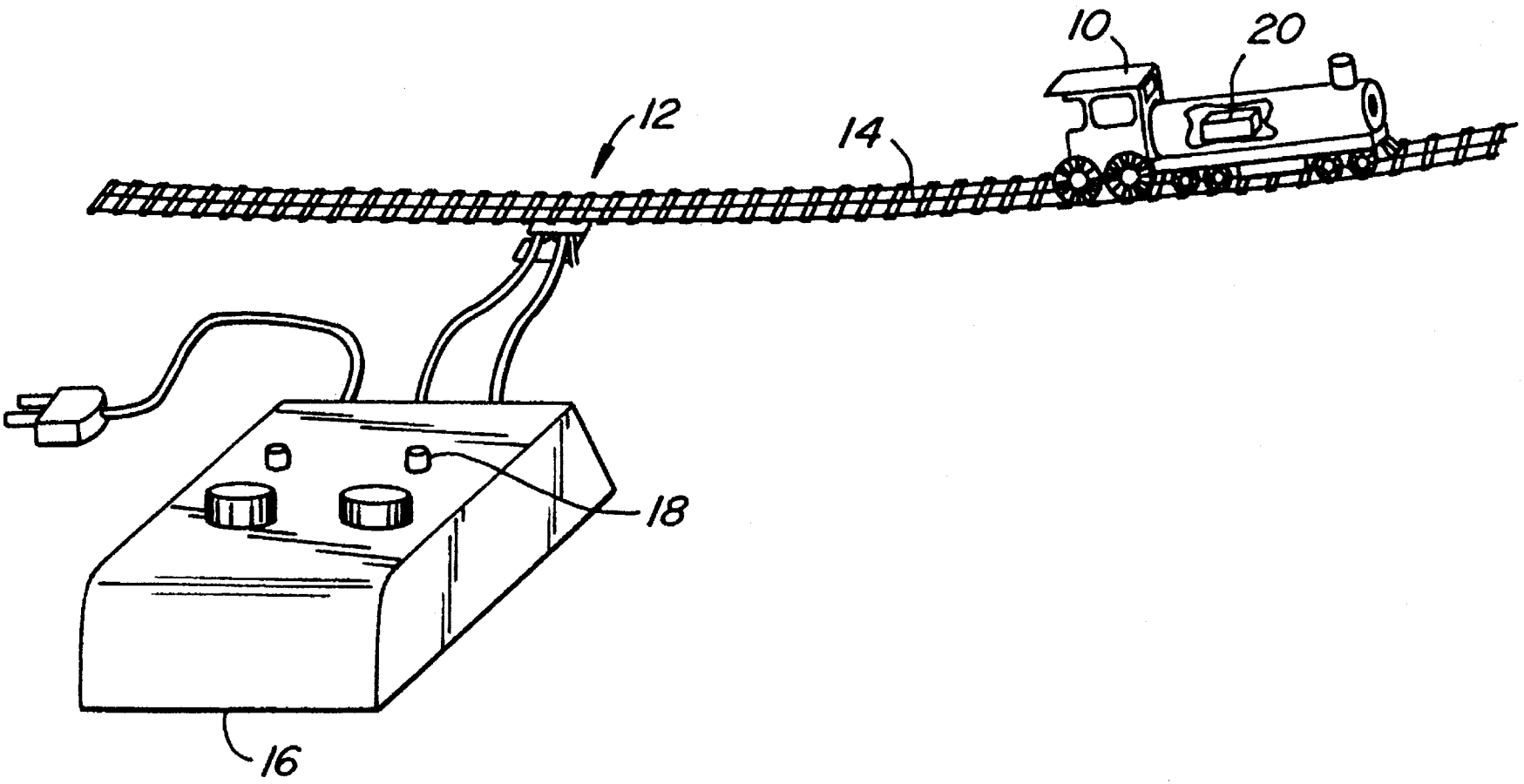
FIG. 1 is a perspective drawing of a layout of a train track system utilizing the present invention.

FIG. 1 is a perspective view of a train layout incorporating the present invention. A locomotive 10 is provided which is driven along a track 12 by a transformer 16 which sends an electric signal along a power rail 14. The embodiment shown is a lionel-like system, which utilizes three rails. In the Lionel system, the center rail is the power rail 14, and carries an AC signal transformed from a standard 60 HZ wall socket. Other systems, such as HO, may utilize two rails and a DC signal. Skilled practitioners will be able to adapt the Lionel system described herein to function on a HO or other track system. The locomotive 10 is retrofitted or produced with a sound generating unit 20 located within the locomotive's body. The transformer 16 shown is a standard Lionel transformer which includes a horn button 18. Activation of the horn button 18 produces a DC voltage on top of the AC track power.

Figure 2:
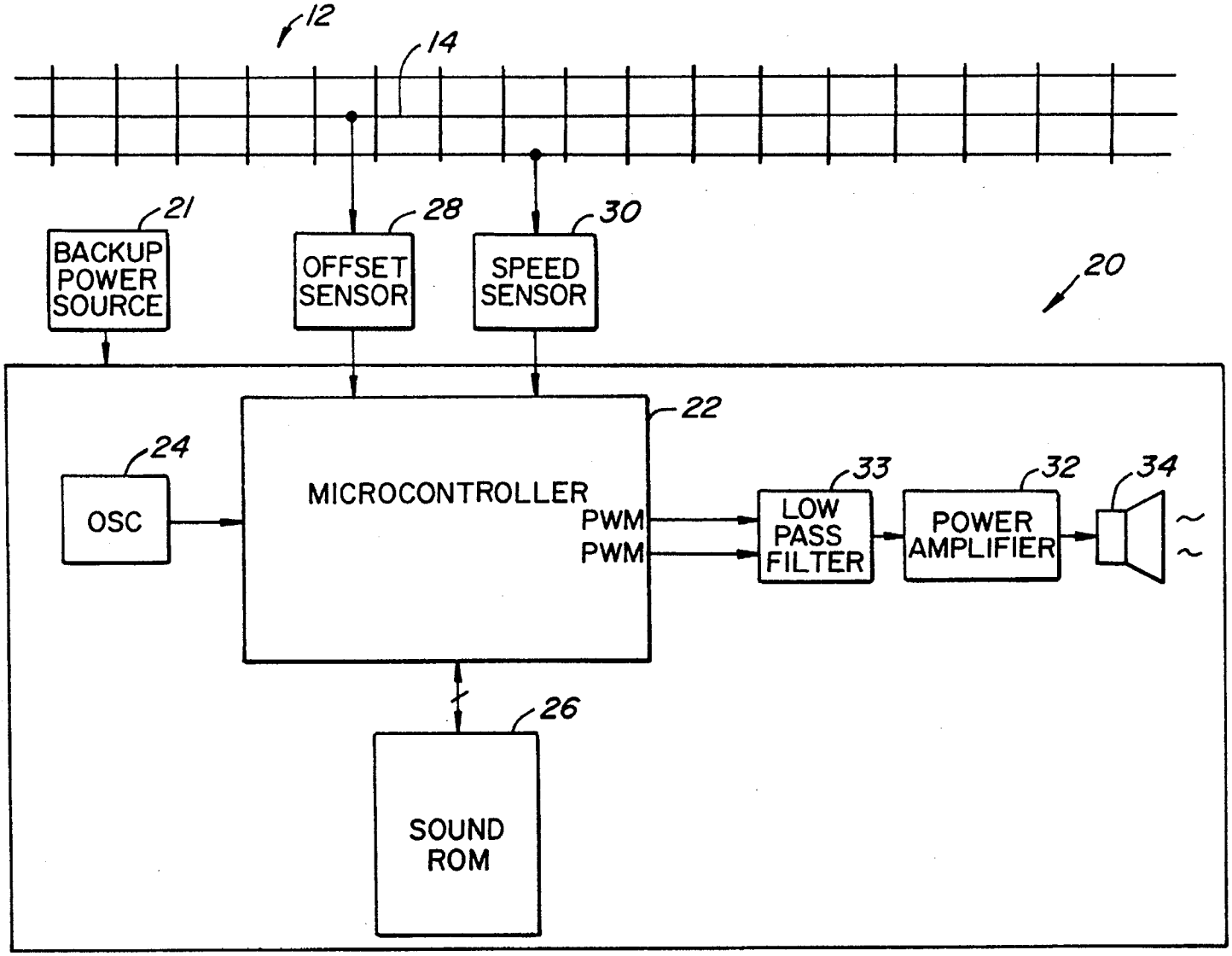
FIG. 2 is a block diagram of the electronics of the sound generation unit of the present invention.

Referring now to FIG. 2, a block diagram of one embodiment of a sound generation unit 20 of the present invention is shown. The unit may, in some embodiments, include a backup power source 21, such as a nicad battery. This source is utilized when track power is removed. As will be described, the battery is only used for short periods. Two sensors, an offset sensor 28 and a speed sensor 30, are utilized to provide input data to a microcontroller 22 which uses the data to select and produce a sound. The offset sensor 28 is electrically coupled to the power rail 14, and is sensitive to either a positive or negative DC offset on the rail. A negative offset, in the preferred embodiment, is generated on the rail 14 when the horn button 18 is depressed.

Speed sensor 30 is utilized to detect the speed of the train when the train is moving in either a forward or a reverse direction. Preferably, speed sensor 30 consists of a cam mounted on an axle of the train, producing electric signals by using hall effect devices. Alternatively, single or double-lobed cherry switches may be used to generate the cam signals. When the train is not moving, but power is applied to power rail 14, the speed detected will be zero, and an idle signal will be input to the microcontroller 22 as the speed signal. This allows the sound to be varied based on the idle speed when the train is not physically moving.

In an alternative embodiment, the speed sensor is comprised of a sensor which detects the track voltage. The sound generation unit will produce variable sounds based upon the magnitude of voltage detected on the track.

The combination of input signals received by the microcontroller 22 is utilized to generate a variety of train sounds. In one embodiment, microcontroller 22 is a PIC17C42 microcontroller available from Microchip Inc. Those skilled in the art will realize that other commercially-available microcontrollers may also be used. The microcontroller includes 2 PWM output lines which are connected to a power amplifier 32 via a low pass filter 33. The amplifier 32 drives a speaker 34. Use of the PWM lines allows the system to be implemented without the need for a digital to analog converter, thereby realizing a reduction in circuit complexity and cost. The microcontroller 22 is coupled to a sound ROM 26. The sound ROM stores digitized sound segments used to generate the various sounds of the present invention. In a typical implementation, the sound ROM 26 contains header information for 50 sound segment records occupying about 256 bytes of space and up to 256,000 bytes for sound segment storage.

The sound ROM includes digitized representations of actual train sounds. This may be accomplished by recording sounds in the field using very high fidelity CD specification audio equipment. In one specific approach, each desired sound is digitally recorded and then studio edited and sample rate converted from 44.1 KHz to 11.025 KHz in sixteen bits. The various sounds can be edited and looped and then sorted to ensure that the resulting various potential juxtapositions of sound segments are as seamless as possible. Skilled practitioners will realize that digital editing equipment may be used to accomplish the required editing and sorting of sounds. Finally, the sound images can be scaled to 10 bits and stored in audio information file format (AIFF) files. The files may then be formatted and compressed into a format which can be burned into a sound ROM 26. In one specific embodiment, the sound images are compressed to 4 bit samples. The microcontroller 22 then decompresses the information back into 10 bit samples. Those skilled in the art will recognize that compression techniques such as adaptive delta pulse code modulation (ADCPM) or its variants may be utilized.

Figure 3:
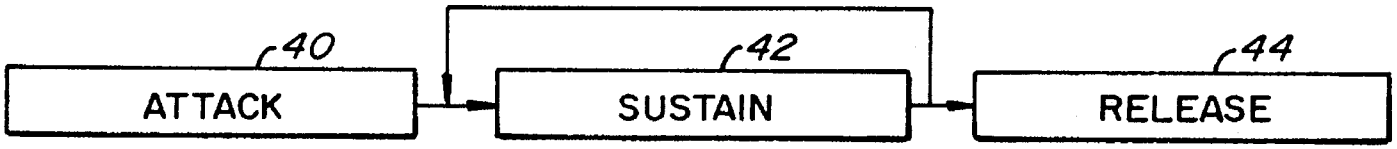
FIG. 3. (PRIOR ART)
FIG. 3 is a flow diagram indicating the generation of a typical horn sound.

The above-described hardware is employed to produce the sounds of the present invention. Generation of the sounds will now be described, by first referring to FIG. 3 which is a flow diagram depicting the steps required to produce a typical horn in, e.g., a Lionel train system. A typical Lionel horn is sounded by the operator depressing the horn button 18 on the transformer 16. When depressed, the horn attack segment 40 is played. A sustain segment 42 will repeatedly be played depending on how long the operator depresses the horn button 18. When the operator releases the button 18, a final release segment 44 will sound. This same sequence repeats every time a typical Lionel horn is sounded. The only variation in sound which was available in such a system was the duration of the horn.

Figure 4:
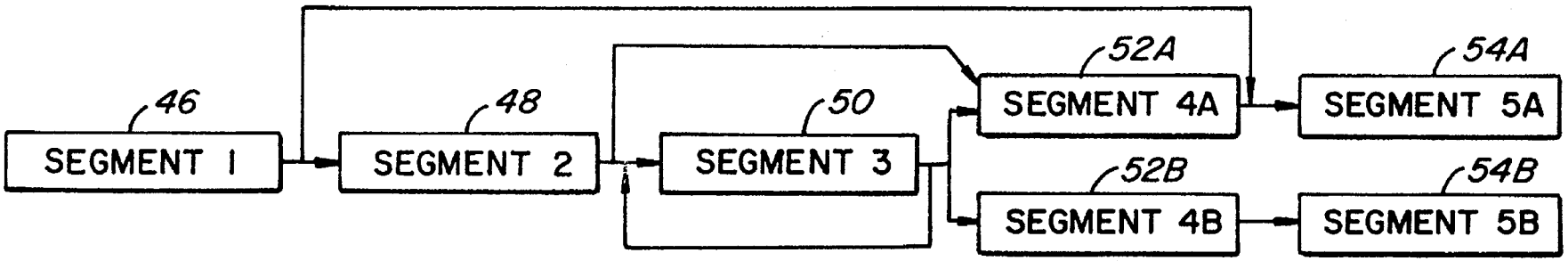
FIG. 4 is a flow diagram depicting the generation of a sound by the sound generation unit of FIG. 2.

One specific embodiment of the present invention departs from this typical sequence by providing a series of five possible horn segments 46, 48, 50, 52, and 54 shown in the flow diagram of FIG. 4. Each segment corresponds to actual sound segments recorded and stored in the sound ROM 26 as discussed above. This format allows a wide array of possible sound combinations. For example, if the user holds the horn button for a brief instant, a quick "toot" will be produced by playing only the first and the fifth segments 46, 54. A short blow may consist of segments 46, 48, 52 and 54. A long blow will be produced by repeatedly playing the third segment 50. To ensure fast horn response to a user input, play of segment 54 may be interrupted by another horn request. Those skilled in the art will appreciate the care that must be taken in editing the recorded sounds so that they may be seamlessly juxtaposed in such a variety of combinations. Other specific embodiments utilize less or more than five discrete segments.

In one embodiment of the present invention, two general horn sounds are available: SOFT and LOUD. To further increase the variety of combinations possible, two different possible release sounds may be used (the release generally corresponding to segments 52 and 54), raising the total number of basic sounds available to four: SOFT, SOFT WOW, LOUD, and LOUD FUNKY. For example, referring to FIG. 4 and assuming the use of the SOFT horn, use of the release depicted by segments 52*a* and 54*a* will result in a SOFT sound. If segments 52*b* and 54*b* are used, a SOFT WOW sound will be played. In general, the length of time that the user depresses the horn button determines the length of the sound played, while the speed of the train is used to determine what type of horn is played, e.g., SOFT, SOFT WOW LOUD or LOUD FUNKY A fast moving train will typically generate a LOUD horn. A slow, or idling train will normally generate a SOFT horn. Rather than relying on exact speed information, the speed of the train is generalized into zones (Zone 0 to Zone 3). The different sound segments are stored and indexed in the sound ROM according to the zone in which they will be used. To ensure that appropriate sounds are generated for each zone, a preferred embodiment of the present invention utilizes a distribution scheme such as that shown in TABLE 1. This distribution scheme is followed when the sounds are stored in the sound ROM.

TABLE 1

| | SOFT | SOFT WOW | LOUD | LOUD FUNKY |
|---|---|---|---|---|
| ZONE 0 | 50% | 25% | 20% | 5% |
| ZONE 1 | 25% | 35% | 20% | 20% |
| ZONE 2 | 0% | 20% | 30% | 50% |
| ZONE 3 | 0% | 0% | 25% | 75% |

Referring to TABLE 1, each time the operator depresses the horn button 18 while the train is stopped and track power is on (i.e., the train is idling), the sounds of Zone 0 will be used. Half of the time, the sound generation unit 20 will produce a SOFT sound according to this distribution. Twenty five percent of the time, the unit 20 will finish the SOFT sound with an alternative release, resulting in a SOFT WOW. Rarely, a LOUD or LOUD FUNKY sound will be produced. In contrast, when the train is moving at full speed (i.e., Zone 3) a SOFT or SOFT WOW sound will never be produced. Although this particular sound distribution is only one of many possible, it has been found to effectively simulate the sounds of real locomotives.

All sounds, whatever the distribution, are stored in the sound ROM 26 and are accessed by the microcontroller 22 when the horn button 18 is depressed. A particular zone is accessed depending on the speed of the train. In one embodiment, a two-dimensional array is utilized, formed of four zones each containing thirty-two horn sounds. The horn sounds are distributed, e.g., as in TABLE 1. The two-dimensional array is seeded with a random entry point. A table pointer is used to point to the next sound in the array. The pointer is incremented by one every time the horn is sounded. The result is a great number of different horn sounds which are produced based, in part, upon the speed of the train. One embodiment of the present system allows an operator to replay a sound he finds particularly pleasing by repressing the horn button within 3 to 5 seconds of the last play of the sound.

The four variations of basic horn sounds may be supplemented by a second general type of sound designed to further heighten the realism of the train layout. Specifically, a variety of background noises which also vary based upon the speed of the train may be provided. These sounds are also stored in the sound ROM 26 and are accessed by the microcontroller 22 based on inputs from the offset sensor 28 and the speed sensor 30. Each of the additional background sounds is varied depending on the relative speed of the model train. For example, one of the sounds stored in the sound ROM may be a "chuffing" noise. The nature of the chuffing sound produced by the sound generation unit 20 changes with the speed of the train. When a train is starting from a stop, the chuffing noise is labored, or drawn out. This simulates the sound made by a locomotive under load. As the train's speed increases, the sound of the chuffs becomes shorter and less labored. As the train slows down, the short chuffs continue to sound. When the train reaches a complete stop, the chuff sound is reset to the labored heavy chuff for the next startup. These additional background noises are generated using software stored in the microcontroller 22 which monitors the speed sensor 30 to detect current speed and to track any variations in speed.

Another style of background sounds produced by the present invention are random sounds generated by the sound generation unit 20 based primarily on the type of train involved (e.g., steam or diesel). For instance, in a real steam engine, different steam compressor noises frequently occur. Actual compressors typically emit intermittent hissing and klunking noises as well as steam letoffs. The noises occur essentially at random, and generally are not dependent upon the speed of the train. To simulate these sounds, the present invention utilizes a software table tailored for each type of train which ensures that certain sounds are randomly played during operation of the train. Again, the sounds are digitized images of actual recordings and are stored in the sound ROM 26, and are accessed and played by the microcontroller 22. In one specific embodiment, the compressor sound is created by constantly looping a hissing sound and by generating klunking noises at different rates in order to produce four different compressor sounds. The compressor and letoff sounds played by the microcontroller 22 may, in one embodiment, stop playing when the train reaches ZONE 2 in speed in order to avoid unnecessary overlaps in sound.

In another specific embodiment, diesel sounds may be generated as background sounds. The diesel engine sound may include compressors, letoffs, fan sounds, and the like. Preferably, the sounds are constantly looped in order to simulate the diesel sound. Realism may be further enhanced by providing a fan sound which activates when the train comes to a stop. Those skilled in the art will appreciate that inputs from the speed sensor 30 may be utilized in a variety of ways in order to generate and vary the sounds produced in the sound generation unit 20.

In another specific embodiment, the present invention produces start-up, shut-down, and let off sounds depending on whether track power has been shut off and for how long. As those skilled in the art will recognize, model railroad locomotives typically carry a "reverse unit" which is used to determine the state of the locomotives operation, i.e., forward, neutral, or reverse. One type of reverse unit resets all locomotives on a given track to a given state if power is removed for over 3½ seconds. To signal this reset to a train operator, one embodiment of the present invention plays a "let-off" sound stored in the sound ROM 26. The reset state typically lasts for 2 seconds After 5½ seconds all locomotives on the track are considered to be shut down. To signal this event, and to simulate real locomotives, the sound generation unit 20 plays a shut-down record stored in the sound ROM 26. During these 5½ seconds, the sound unit 20 is powered by a backup power source 21. Once the shut-down sound is played, the backup power source 21 shuts off. Any time power has been off for over 5½ seconds, the sound generation unit 20 will play a start-up sound when power is reapplied. The net effect is the creation of realistic sounds which alert the operator to the status of the model vehicles.

As will be understood by those familiar with the art, the present invention can be embodied in other specific forms without departing from the spirit or essential characteristics thereof. For example, the sound generating unit 20 may be modified for use in a model automobile layout or any other model vehicle. In addition, other sounds may be digitized and stored in the sound ROM and accessed by the micro-controller.

Accordingly, the disclosure of the preferred embodiment of the invention is intended to be illustrative, but not limiting, of the scope of the invention which is set forth in the following claims.

What is claimed:

1. A sound system for producing a variable sound from a model vehicle on a track, comprising:

a user input located on said model vehicle for receiving a user control signal, said user control signal having a variable duration;

a speed input for producing a second control signal indicating a desired speed of said vehicle along said track; and a sound generation unit responsive to a combination of said user control signal and said second control signal for generating said variable sound, said Sound generation unit including a plurality of stored sound segments and circuitry for selecting varying combinations of said stored sound segments responsive to said user control signal and said second control signal;

wherein said variable sound varies in accordance with each of said first and second control signals.

2. The sound system of claim 1 wherein said variable sound is repeated if said user input is reactivated within a predetermined period of time.

3. The sound system of claim 1 wherein when said model vehicle is stopped, said second control signal is generated from a voltage carried on said track.

4. The sound system of claim 1 wherein said second control signal is generated from a voltage carried on said track.

5. The sound system of claim 1 wherein said sound generating device further comprises:

a microcontroller, responsive to said user control signal and said second control signal, for combining said signals and producing an address based on a duration of said user control signal and a magnitude of said second control signal;

a sound memory, addressable by said microcontroller, having a plurality of addressable storage locations, each of said storage locations containing sound information, said memory further having an output for outputting a variable sound signal; and a speaker, coupled to said sound memory and responsive to said sound signal, for producing a variable sound based on said sound information.

6. The sound system of claim 1 wherein said sound generation unit further comprises means for generating a third pseudo-random control signal for varying said variable sound within a predetermined range for the same values of said user and said second control signal.

7. The sound system of claim 6 wherein said range varies in accordance with said second control signal.

8. The sound system of claim 1 wherein said variable sound is a horn consisting of at least three discrete segments.

9. The sound system of claim 1 wherein said variable sound is a background noise.

10. The sound system of claim 6 wherein said sound generation unit further comprises a back up power source.

11. A sound system for producing a variable sound from a model vehicle on a track, comprising:

a user input located on said model vehicle for receiving a user control signal having a variable duration;

a speed input for producing a second control signal indicating a desired speed of said vehicle along said track; and a sound generation unit responsive to a combination of said user control signal and said second control signal for generating said variable sound;

wherein said sound generation unit further comprises a microcontroller, responsive to said user control signal and said second control signal, for combining said signals and producing an address based on said duration of said user control signal and a magnitude of said second control signal;

a sound memory, addressable by said microcontroller, having a plurality of addressable storage locations, each of said storage locations containing sound information, said memory further having an output for outputting a variable sound signal;

a speaker, coupled to said sound memory and responsive to said sound signal for producing a variable sound based on said sound information;

a plurality of stored sound segments and;

means for selecting varying combination of said stored sound segments responsive to said user control signal and said second control signal; and means for generating a third pseudo-random control signal for varying said variable sound within a predetermined range for the same values of said user control signal and said second control signal;

wherein said sound generation unit produces a variable sound which varies in accordance with each of said user and said second control signals.

12. A sound system for producing a variable sound from a model vehicle on a track, comprising:

a user input device coupled to said track, said device producing a first control signal having a variable duration;

a receiver in said model vehicle responsive to said first control signal;

a speed indication device in said model vehicle responsive to movement of said model vehicle along said track, said speed indication device producing a second control signal having a magnitude; and a sound generation device having inputs coupled to said receiver and said speed indication device and having an output producing a variable sound, said sound generation device further storing a plurality of sound information segments addressable by a combination of said first and second control signals;

wherein said sound varies based on said duration of said first control signal and said magnitude of said second control signal.

13. The sound system of claim 12, wherein when said model vehicle is stopped or moving, said second control signal is generated from an AC track signal carried on said track.

14. In a model vehicle, a method for producing a variable sound comprising the steps of:

generating, in an operator input device, a horn signal having a variable duration;

generating, in said model vehicle, a speed indication signal having a magnitude;

receiving, in a sound generation device, said speed signal and said horn signal;

addressing a memory in said sound generation device, using said speed signal and said horn signal to select an at least first sound segment stored within said memory;

generating, in said sound generation device, said variable sound based on said magnitude of said speed signal and said duration of said horn signal, said variable sound containing said at least first sound segment.

15. The method for producing a sound of claim 14 wherein said model vehicle is of a specific type, the method further comprising the step of generating, in said sound generation device, a background sound based on said specific type of said model vehicle.

16. The method for producing a sound of claim 15 wherein said specific type of said model vehicle is a diesel locomotive.

17. The method for producing a sound of claim 15 wherein said specific type of said model vehicle is a steam locomotive.

18. The method for producing a sound of claim 15 further comprising the step of generating, in said sound generation device, a second background sound based on said specific type of model vehicle and said magnitude of said speed signal.

19. The method for producing a sound of claim 14 further comprising the step of generating, based on the amount of time a track power source has been turned off, start up and shut down sounds.

* * * * *